United States Patent [19]

Harbour

[11] Patent Number: 4,972,982

[45] Date of Patent: Nov. 27, 1990

[54] PERSONAL PAINT CADDY

[76] Inventor: Stephen M. Harbour, 1002 Indian Dr., Enid, Okla. 73703

[21] Appl. No.: 459,136

[22] Filed: Dec. 29, 1989

[51] Int. Cl.[5] ..... A45F 5/00; A45F 3/14

[52] U.S. Cl. ..... 224/270; 224/148; 224/257

[58] Field of Search ..... 224/148, 270, 208, 42.45 R, 224/246, 261, 262, 272, 257, 901, 195, 226, 253, 904, 908, 240; 248/311.2, 315

[56] References Cited

U.S. PATENT DOCUMENTS 1,145,176 7/1915 Willson ..... 224/148

4,172,542 10/1979 Lankford ..... 224/148

*Primary Examiner*—Henry J. Recla

*Assistant Examiner*—David J. Walczak

*Attorney, Agent, or Firm*—Richard K. Thomson

[57] ABSTRACT

A personal paint caddy which permits a container with spillable material to be suspended from the body of a workman without danger of spillage. A pair of gimbal rings suspends the container from a U-shaped support which is mounted on the body of the workman by way of a pair of belt-encircling loops and a shoulder harness. The gimbal rings permit the container to be maintained in a vertical position even though the workman will bend, stoop, twist and turn in the course of normal painting activity.

8 Claims, 1 Drawing Sheet

PERSONAL PAINT CADDY

BACKGROUND AND SUMMARY OF THE INVENTION

One of the most significant difficulties facing a do-it-yourself house painter (or a professional, for that matter) is what to do with the container of paint or stain. Carrying the can by its bail soon becomes tiresome and, anyway, nine times out of ten, the can will bump into a ladder, or a knee and spill half its contents on the ground.

One solution to this problem is to suspend the can from the ladder by one means or another. The trouble is that sooner or later, you wind up in one place and the can in another so you have to climb down to reload the brush or move the suspending device risking spillage once more.

A number of attempts have been made to address these problems. For example, U.S. Pat. Nos. 2,987,231, 2,995,281; and 3,285,485 issued to Lewis, Dixon, and Bedsaul, respectively, all teach the use of harnesses or other means to suspend a paint container from the body of the painter. Lewis and Bedsaul suspend the can by its bail so that the contents are subject to the same risk of spillage as when the can is hand held. The harness of the Dixon device makes no provision for the bending and reaching that occurs during painting and, accordingly, the contents of the can are, similarly, subjected to spillage.

U.S. Pat. No. 3,051,428 issued to Schult discloses a self-leveling device for a paint container. However, the Schult device is designed to be attached to the leg of a ladder and, hence, does not accompany the workman as he/she progresses. This requires either the up and down movement of the workman to reload the brush or periodic movement of the can and the brace with the potential for spillage attendant therewith.

U.S. Pat. No. 3,876,125 to Emmert teaches the use of a body-mounted support for a paint container including a shoulder strap and a can supporting strut that rests against a body portion such as a hip, or the like, the can being suspended by a pair of pivots that replace the bail. This suspension device enables the can to pivot only about a single axis as if suspended by its bail and, therefore, does not make provision for the full body motion, bending and reaching, associated with normal painting activities.

U.S. Pat. No. 4,325,503 to Swinney discloses a body-mounted rack supported by a waist-mounted belt. The rack provides partial pivotal movement about two axes so as to maintain a vertical position. However, should the wearer lean away from the can, her/his leg will restrain possible corrective pivotal movement and then paint will become part of the external attire of the wearer.

The present invention overcomes the deficiencies of these earlier attempts. The personal paint caddy of the present invention includes a U-shaped support whose ends may be secured to the wearer's belt by means of a pair of wrap-around securing loops. These loops may be equipped with Velcro self-adhering fabric for quick attachment. A support strap encircling the wearer's neck and connected to eyelets on either side of the U-shaped support, may be adjusted to accommodate the size of the wearer in order to maintain the support substantially perpendicular to a portion of the wearer's longitudinal axis. A pair of concentric gimbal rings secured to the U-shaped support permit pivoting of the container about two axes under the influence of gravity thereby permitting the container to retain its longitudinal axis in a vertical position even though its wearer may bend or stoop at angles up to 45 degrees from vertical during the normal activity of painting.

Various other features, advantages, and characteristics will become apparent after a reading of the following detailed description.

DETAILED DESCRIPTION OF THE PREFERRED EMBODIMENT(S)

Figure 1:
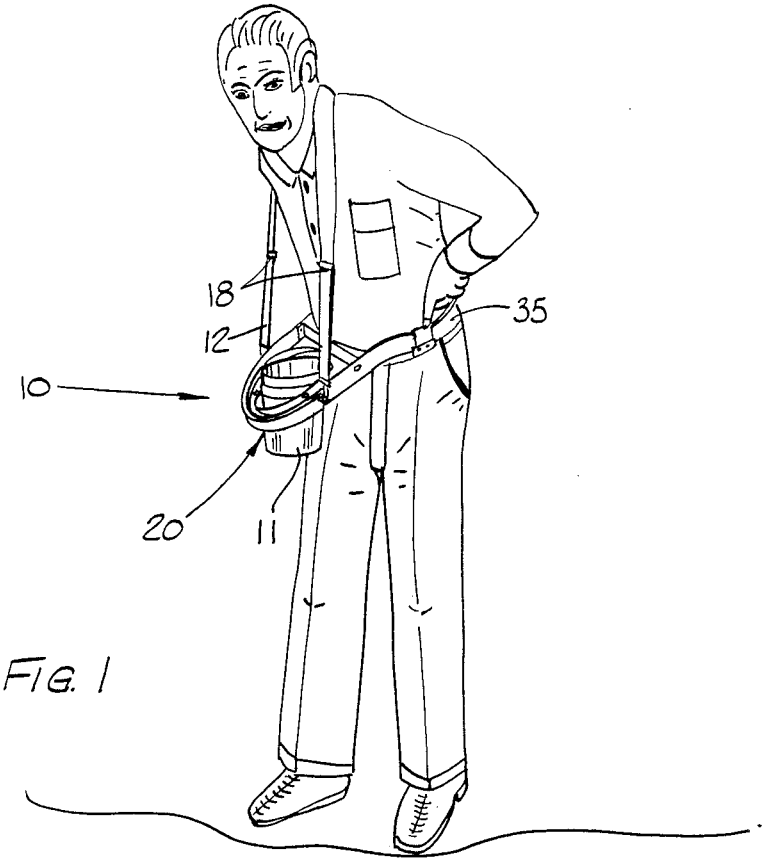
FIG. 1 is a perspective view of the personal paint caddy of the present invention depicting one manner in which it might be used.
Figure 2:
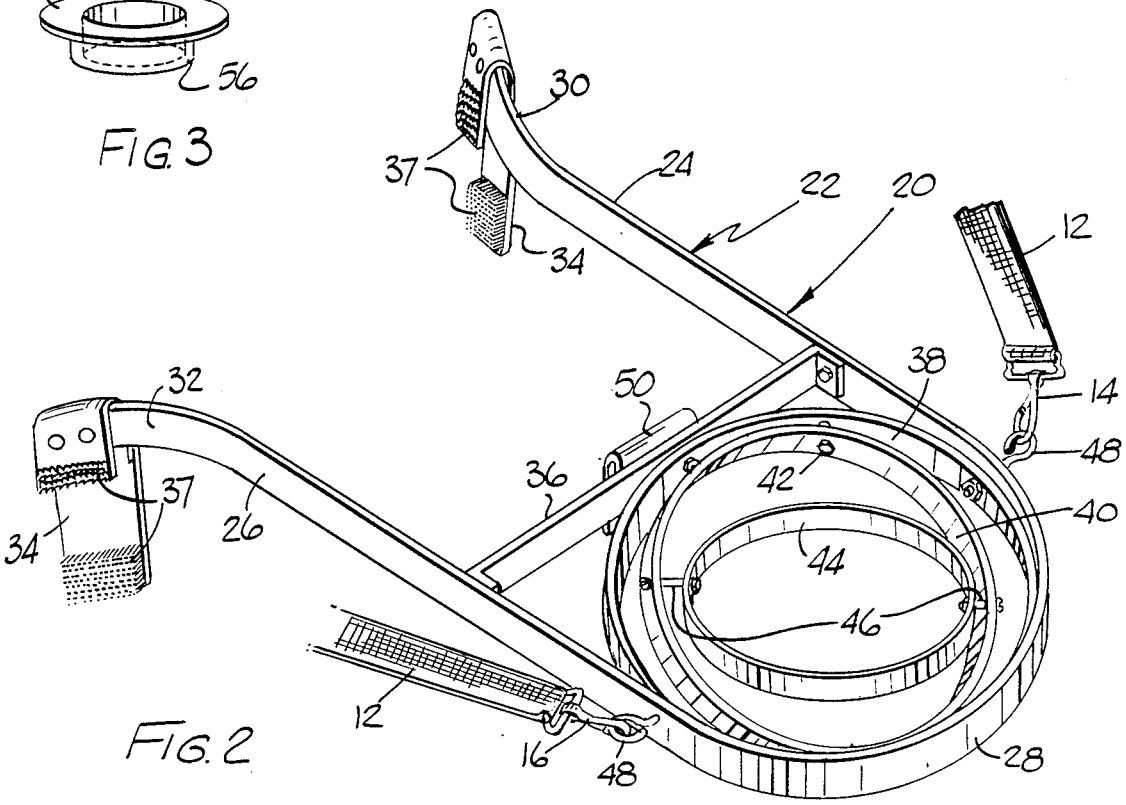
FIG. 2 is an enlarged perspective view of the personal paint caddy of the present invention.

The personal paint caddy of the present invention is depicted in FIG. 1 generally at 10. Caddy 10 comprises two principal components: adjustable shoulder strap 12 and support member 20. Caddy 10 is shown as supporting a container 11 which, although suitable for retaining paint, stain, and the like could also be useful with roofing nails; rivets; threaded fasteners; nuts; indeed, any liquid or article which is utilized in high volumes and needs to be readily available to the workman. Further, while FIG. 1 depicts the container being supported directly in front of the workman, the personal paint caddy might more beneficially support the container adjacent a hip of the workman, the right hip for a right-handed workman, the left hip for a left-handed workman. The choice of deployment is left entirely to the workman, as the personal paint caddy 10 can readily support container 11 in any position desired. Support member 20 includes a generally U-shaped support bracket 22 (FIG. 2) which has first arm 24 and second arm 26 extending from the base 28 of the U. Each end 30, 32 is flaired slightly 25–35 degrees to accommodate a range of waist sizes. Each end 30, 32 has affixed thereto by rivets, brads, or the like, a belt-encircling strip 34 which comprises retaining means to enable securement of ends 30, 32 to the wearer's belt 35. Strips 34 are preferably equipped with a self-adhering material 37 (such as Velcro fabric) on opposite ends and opposite sides of the strips 34 to permit quick securement by the wearer to her/his belt 35. It will of course be understood that other retaining means such as clips, or the like, may be employed.

A laterally-extending reinforcing strut 36 may be provided between first and second arms 24, 26 and is fastened thereto. An annular support 38 can be fastened to the base 28, the two arms 24, 26 of U-shaped support bracket 22, as well as to strut 36. A first ring 40 is secured to annular support by gimballing rods 42 (one shown) and second concentric gimbal ring 44 is secured to first ring 40 by gimballing rods 46. The pivot axis of rods 46 is orthogonal to that of gimballing rods 42 to permit independent pivotal movement. Eyelets 48 are secured to arms 24, 26 immediately opposite each other and adjacent base 28. A C-shaped clip 50 may be secured to the outer surface of reinforcing strut 36 to permit retention of a paint brush by the personal paint caddy 10. The clip 50 might alternatively be positioned on the outside of the base of U-shaped support bracket 22.

Shoulder strap 12 has first and second clips 14 and 16 secured to opposite ends of strap 12 to permit easy connection thereof to eyelets 48. The length of strap 12 may be readily adjusted by conventional adjustment means 18 provided on each end of strap 12 doubling the strap back upon itself through a ring provided on clips 14, 16. In this manner, clips 14, 16 appear to be at the ends of strap 12. The adjustment means 18 permit the length of the strap 12 to be altered to fit different sized wearers as well as to accommodate different positions of the container 11 (center mount or hip mount). The strap 12 should be adjusted in length to position the support member 20 substantially perpendicular to at least a portion (the waist) of the longitudinal axis of its wearer when he/she is standing upright. While support member 20 may be made of light-weight metals such as aluminum, it is more preferably constructed of a durable, rigid injection molded plastic to reduce manufacturing costs.

The workman simply loops the strips 34 around her/his belt securing the Velcro fabric to position the U-shaped support 22 for either front or side mounting, slips the strap 12 over her/his head (if she/he has not done so already), and adjusts the length of strap 12 using means 18 to level member 20. Inner gimbal ring 44 is then ready to receive a paint container 11. As the workman moves about, bending and reaching, in the normal course of painting, concentric gimbal rings 40, 44 will permit the gravitational pull on container 11 to maintain its longitudinal axis vertically oriented even though the workman's body may assume angles up to 45 degrees from vertical. Further, as the workman twists or turns, gimbal rings 40, 44 will permit the container 11 to react to centrifugal force, allowing the bottom of container 11 to swing outwardly, again, avoiding spillage of the contents.

Figure 3:
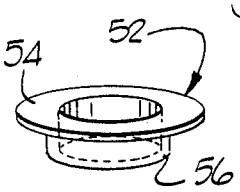
FIG. 3 is a perspective view of an insert adapted to be inserted within the inner gimbal ring to accommodate a smaller container.

In FIG. 3, an insert ring 52 is depicted. Insert 52 has a flange 54 which protrudes laterally outwardly and rests on (but does not extend past) the upper surface of inner gimbal ring 44 while stem 56 is received within inner gimbal ring 44. The ring insert 52 will enable a personal paint caddy which is capable of handling a one gallon size container to accommodate a one quart container, for example. A set of such inserts would, obviously permit a range of container sizes to be handled by a single personal paint caddy.

The personal paint caddy 10 of the present invention permits the workman to bend, stoop, twist, etc., as the normal activity of painting requires. He/she may tilt his/her torso up to angles of 45 degrees without risk of spilling the contents of container 11, as well as twist and turn, the gimbal rings permitting tilting as a result of centrifugal force which aids in avoiding spillage. The personal paint caddy can be a welcome addition to any workman's work bench.

Various changes, alternatives, and modifications will become apparent to those of ordinary skill in the art following a reading of the foregoing specification. It is intended that all such changes, alternatives and modifications as fall within the scope of the appended claims be considered part of the present invention.

I claim:

1. A personal paint caddy for supporting a container of paint, or the like, upon the body of the wearer without spilling the contents of said container during normal painting activity, said wearer having a longitudinal axis, said paint caddy comprising:

(a) a support member including a U-shaped support bracket having a first arm and a second arm, said U-shaped support bracket including a first end on said first arm and a second end on said second arm;

(b) securement means affixed to said first and second ends of said arms for attachment to a belt of said wearer;

(c) a shoulder strap secured to said U-shaped support at opposing points on said first and second arms, respectively; and (d) a pair of concentric gimbal rings adapted to receive a container of paint, or the like, and maintain said container substantially vertical by the interaction of gravity in spite of the bodily orientation of its wearer during normal movements associated with painting.

2. The personal paint caddy of claim 1 further comprising first and second eyelets positioned at said opposing points on said first and second arms and first and second clips attached to each end portion of said strap, said clips engaging in said eyelets.

3. The personal paint caddy of claim 1 wherein said shoulder strap is adjustable by means of doubling back loop means to maintain said U-shaped support bracket substantially perpendicular to at least a portion of said wearer's longitudinal axis.

4. The personal paint caddy of claim 1 wherein said securement means comprise belt-encircling strips, said strips being formed with two portions of self-adhering material on opposed ends thereof.

5. The personal paint caddy of claim 1 further comprising a laterally extending reinforcing strut extending between said first and second arms and being secured thereto.

6. The personal paint caddy of claim 1 further comprising a clip adapted for receiving and retaining a paint brush, said clip being attached to a portion of said U-shaped support bracket.

7. The personal paint caddy of claim 6 wherein said portion of said U-shaped support bracket to which said clip is connected comprises said reinforcing strut.

8. The personal paint caddy of claim 1 further comprising at least one ring insert receivable within an innermost gimbal ring to enable accommodation of a smaller-sized container.

* * * * *